United States Patent [19]

Lyman

[11] 4,456,137

[45] Jun. 26, 1984

[54] VENTING ARRANGEMENT FOR COVERED CONTAINERS

[75] Inventor: George Lyman, Kennebunkport, Me.

[73] Assignee: Data Packaging Corporation, Cambridge, Mass.

[21] Appl. No.: 399,907

[22] Filed: Jul. 19, 1982

[51] Int. Cl.[3] ..... B65D 41/04

[52] U.S. Cl. ..... 215/230; 215/307; 215/330; 215/331

[58] Field of Search ..... 215/307, 330, 331, 332, 215/230, 313; 220/366

[56] References Cited

U.S. PATENT DOCUMENTS

| | | | |
|---|---|---|---|
| 3,216,600 | 11/1965 | Dreps | 215/230 |
| 4,289,248 | 9/1981 | Lynn | 215/307 X |
| 4,335,074 | 6/1982 | Bernas | 215/230 X |

FOREIGN PATENT DOCUMENTS

| | | | |
|---|---|---|---|
| 410775 | 5/1934 | United Kingdom | 215/332 |

*Primary Examiner*—Donald F. Norton

*Attorney, Agent, or Firm*—Wolf, Greenfield & Sacks

[57] ABSTRACT

A bottle with a two position cap for sealing and venting the bottle. The bottle has an opening defined by a neck and the neck has external helix threads. The threads are divided into two threaded segments separated by two diametrically opposed unthreaded regions. Each of these threaded segments lies between large ribs on the neck and the bottle opening. The large ribs extend half way around the external surface of the neck. Indexing ribs extend axially on the neck. The bottle cap has internal helix threads that also are divided into two threaded segments separated by two diametrically opposed unthreaded regions as on the neck of the bottle. A pair of spherical detents on the cap lie between each threaded segment and the open end of the cap such that each pair of detents may snap over one of the large ribs on the neck with a detent on each side of an indexing rib to loosely hold the cap on the bottle and indicate that the cap is in a venting position. The cap and bottle threads can be engaged to seal the bottle opening by rotating the cap on the neck causing one detent to snap over each indexing rib.

8 Claims, 12 Drawing Figures

VENTING ARRANGEMENT FOR COVERED CONTAINERS

BACKGROUND OF THE INVENTION

This invention relates to vents for bottles, containers, and the like and more particularly comprises a new vent arrangement for use with bottles that must periodically be allowed to "breathe".

It is often desirable to have a container which may be either sealed or vented as desired. A container with this capability has numerous applications, e.g., as laboratory ware used to grow tissue cultures. At present, containers with conventional threaded caps are used for that purpose. Venting is accomplished merely be backing off the cap from the sealed position. Trial and error is required to establish the amount of loosening needed to create an adequate vent, and if an error is made important and complex experiments or processes may be ruined. Furthermore, an improperly vented container may create a danger through container overpressurization and possible rupture. This technique of venting containers obviously is inprecise and undependable, and has prompted the development of the present invention.

The principle object of the present invention is to provide an inexpensive container and cap combination that is simple to use and capable of dependably either sealing or venting a bottle or container as desired.

Another object of the present invention is to provide a container and cap combination having a visual indicator for revealing whether the cap is in the seal or vent position.

SUMMARY OF THE INVENTION

The container of this invention has a threaded neck which receives the threaded cap or closure. The threads are interrupted to define an unthreaded region. Located within this region is an indexing rib and large rib that serves as a stop. The threaded container closure may be threaded onto the container threads to seal the opening of the container. The closure includes a detent which registers with the indexing rib and overlaps the large rib to loosely hold the cap on the container thereby venting the container. The interruption in the threads allows the detent to engage the indexing rib and snap over the large rib without interference between the container threads and the closure threads.

These and other objects and features of the present invention will be better understood and appreciated from the following detailed description of one embodiment thereof, selected for the purpose of illustration and shown in the accompanying drawing.

DETAILED DESCRIPTION OF ONE EMBODIMENT OF THE PRESENT INVENTION

A bottle 10 used for growing tissue cultures is described and shown herein for purposes of illustrating one important application of the invention. In use, liquid including a growth medium and a tissue sample are injected into the bottle and subsequent spinning or rolling of the bottle coats its inside surface with the liquid and the tissue culture. Periodically, it is necessary to open the bottle and allow it to breathe to promote tissue growth. The present invention is intended to facilitate that operation and make it more precise.

Figure 10:
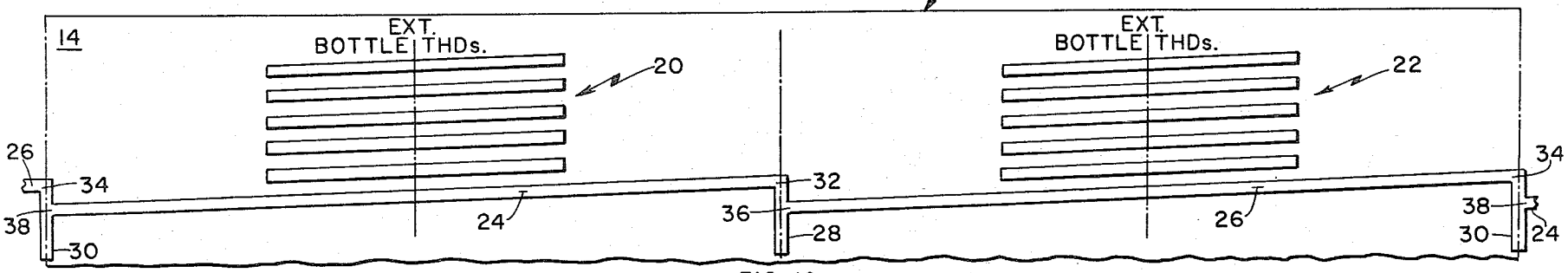
FIG. 10 is a developed view of the bottle neck shown in FIG. 5 with the cylindrical wall having been removed.

Rising out of bottle 10 is neck 14 which defines an opening 16. The outer surface 18 of the neck includes two diametrically opposed threaded segments 20 and 22 (see FIG. 10), each somewhat less than 90° in circumferential extent, and underneath which are longer threads or ribs 24 and 26 each extending about substantially 180° and together extending fully around the bottle neck. A pair of indexing ribs 28 and 30 are also included on the outer surface, which join the adjacent ends of ribs 24 and 26. In the preferred embodiment each threaded segment consists of five external threads.

The indexing ribs 28 and 30 extend generally perpendicular to ribs 24 and 26 on the outer surface of the neck. The top of indexing rib 28 joins the higher end 32 of rib 24, and at its midportion indexing rib 28 joins the lower end 36 of rib 26. Similarly, the top of indexing rib 30 joins the upper end 34 of rib 26 and at its midportion joins the lower end 38 of rib 24. The indexing ribs 28 and 30 extend away from the opening in the neck and terminate below the large ribs 24 and 26.

Figure 9:
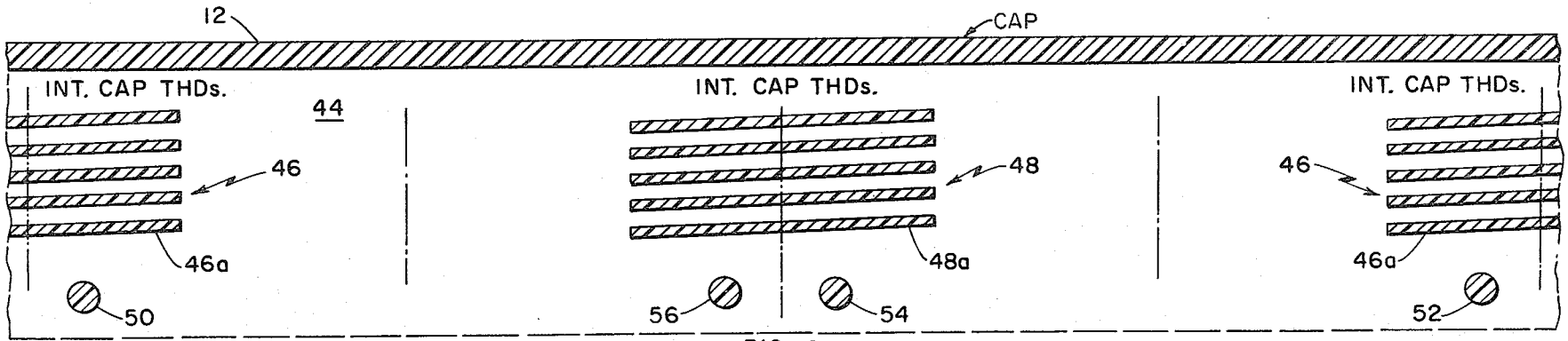
FIG. 9 is a developed view of the bottle cap shown in FIG. 3, the cylindrical wall having been removed to allow the threads to be seen in full lines.

The cap 12 for bottle 10 consists of a circular top 40 and a cylindrical side wall 42 depending from the top. Threaded inner surface 44 has two threaded segments 46 and 48 (see FIG. 9) located diametrically opposite each other and like the segments 20 and 22 in the cap extend less than 90° about the cap. Each threaded segment 46 and 48 consists of five internal threads threadably engageable with threaded segments 20 and 22 on the outer surface 18 of the neck 14 of the bottle. Directly below each threaded segment 46 and 48, between the threads and the open end of the cap, are located a pair of hemispherical detents 50, 52 and 54, 56, respectively. The detents in each pair of detents are separated by a distance equal to or greater than the thickness of one indexing rib.

The bottle 10 has a pair of indexing bosses 58, 60 located on shoulder 62, and the cap 12 includes a raised indexing strip 64 that extends over top 40 and down the side wall 42. Each indexing boss is aligned with an indexing rib, and strip 64 is aligned with an imaginary line extending between the pairs of detents. The outer surface of the cap sidewalls may be fluted as illustrated in the drawings to provide an improved gripping surface.

Figure 11:
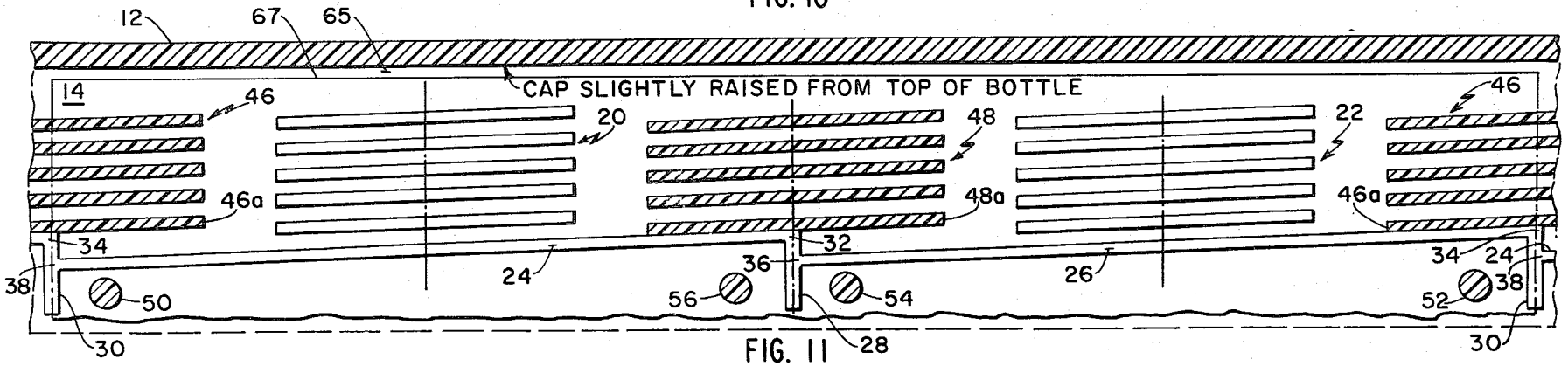
FIG. 11 is a developed view of the cap and the neck with the cap in the venting position.

To mount the cap on the bottle, indexing bosses 58 and 60 of the bottle are aligned with the strip 64 on the cap, which in turn aligns the threaded sections 46 and 48 on the cap with the gap between the threaded sections 20 and 22 on the neck. The cap can then drop freely onto the neck, until the detents 52 and 56 engage the ends 32 and 34 of the ribs 24 and 26, respectively. By pressing the cap firmly onto the bottle neck, the resistance created by the interference between the detents 52 and 56 and ribs 24 and 26 may be overcome, and the detents will snap over those ribs. At the same time the other detents 50 and 54 will snap over the lower ends of the ribs 24 and 26, and the pairs of detents 50, 52 and 54, 56 will lie on opposite sides of the indexing ribs 28 and 30 as shown in FIG. 11. Each detent acts with a rib to restrain either turning the cap or axially removing the cap from the neck. A detent and a rib comprised a detent means in this embodiment. The downward travel of the cap on the neck is stopped by the engagement of the lowermost threads 46*a* and 48*a* with the high ends of ribs 24 and 26 as shown in that figure. In that position, the top of the neck is spaced from the inside surface of the top wall 40 of the cap as suggested at 65 in FIG. 11, and a vent passage is present over the top edge 67 of the bottle neck and between the outer surface of the neck and inner surface of the cap. The lower most threads of the neck 46*a* and 48*a* and the higher ends of the ribs 24 and 26 comprise a stop means in this embodiment.

Figure 12:
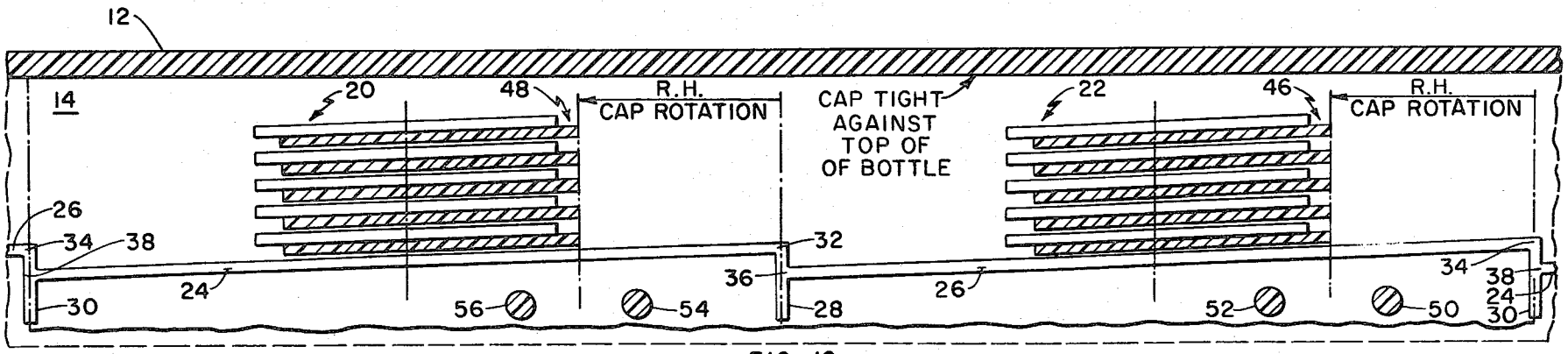
FIG. 12 is a developed view of the cap and neck with the cap in the sealing position on the neck.

To seal the bottle 10, the cap is rotated clockwise on the neck (to the left as viewed in FIGS. 11 and 12) which causes the detents 50 and 54 to snap over the indexing ribs 30 and 28 respectively, and the threads on the neck draw the threads on the cap downwardly until the top edge of the neck bears against the inside of the top wall 40 of the cap and forms a seal as shown in FIG. 12. The pitch and extent of the threads may be designed so that the seal is formed simultaneously with full thread interengagement of the cap and bottle neck. To allow the bottle to breathe, the cap need only be turned counterclockwise until one click or snap is felt as the detents 50 and 54 once again ride over the indexing ribs 30 and 28.

In the embodiment illustrated the bottle and cap are molded from plastic, and the threads have a pitch of ten threads per inch, a depth of 0.050 inch and a 2° helix. The thread roots and crests are flat. The cross section of each indexing rib 28 and 30 may be identical to the thread cross section.

Figures 1, 2, 3, 4, 5, 6, 7, 8:
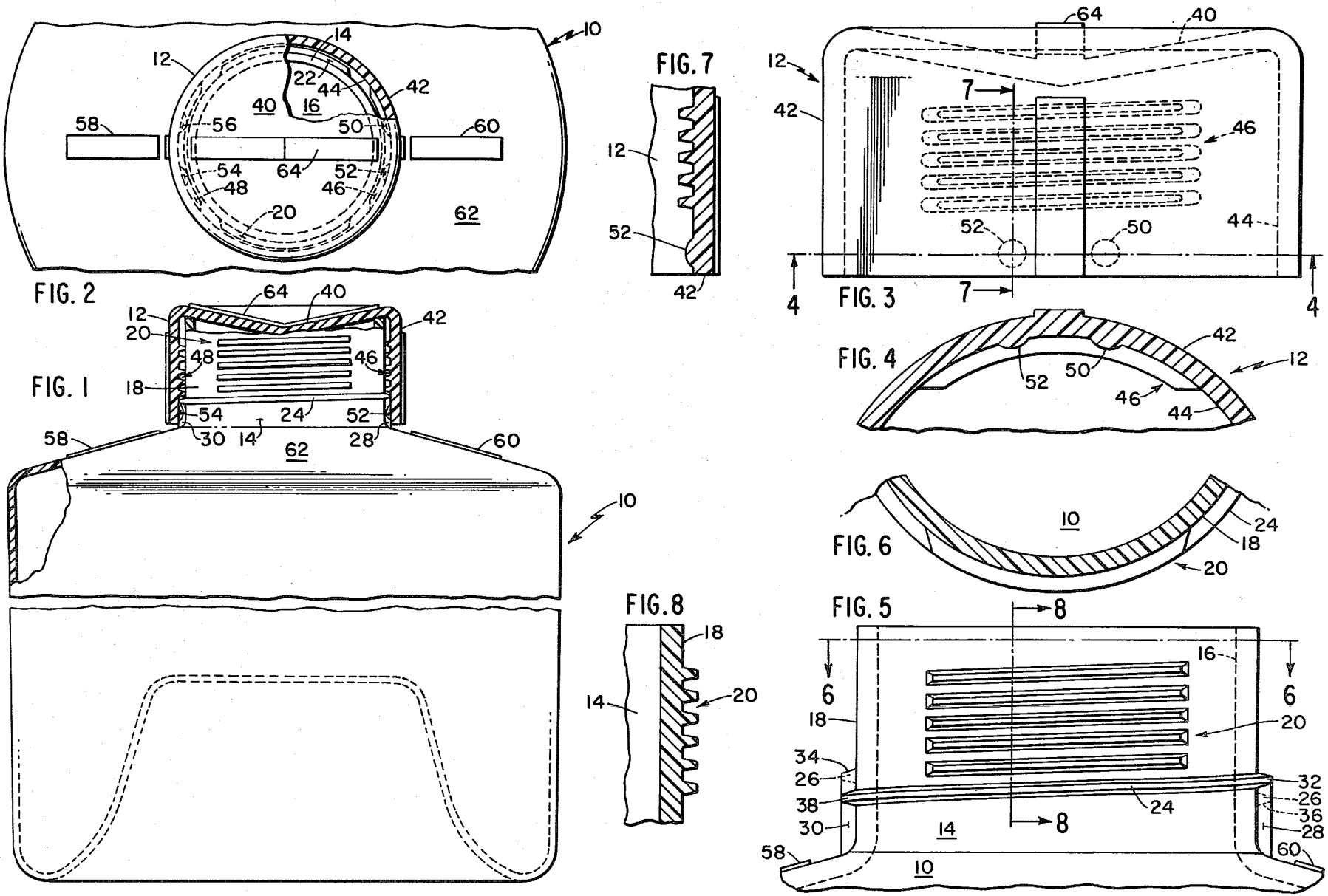
FIG. 1 is an elevation of a roller bottle and cap embodying the present invention with part of the cap and bottle cut away.
FIG. 2 is a top view of the bottle with a portion of the top of the cap removed.
FIG. 3 is an elevation of the cap.
FIG. 4 is a fragmentary cross-sectional view of the cap taken along line 4—4 of FIG. 3.
FIG. 5 is an elevation of the neck portion of the roller bottle.
FIG. 6 is a fragmentary cross-sectional view of the bottle neck taken along line 6—6 of FIG. 5.
FIG. 7 is a fragmentary cross-sectional veiw of the cap threads taken along line 7—7 of FIG. 3.
FIG. 8 is a fragmentary cross-sectional view of the threads of the bottle neck taken along line 8—8 of FIG. 5.

As shown in FIG. 1, the bottom 66 of bottle 10 is concave and shaped to receive the top of another identical bottle. This bottom configuration allows the bottles to be efficiently and conveniently stacked for shipment and storage.

From the foregoing description, those skilled in the art will appreciate that all of the objects of the present invention are realized. The indexing bosses on the bottle and strip on the cover visually indicate to the user when the cap is in the vent position on the container. If the bosses and strip are aligned, the cap necessarily is in the venting position. The condition of the cap vis a vis the bottle is also signaled by the detents and indexing ribs on the cap and bottle respectively, as the user can feel the detents snap over the indexing ribs. Moreover, they provide sufficient interference so that the cap is not likely to be moved from one position to another inadvertently. The detent action will also prevent the cap from accidentally falling from the neck of the bottle when the threads are disengaged because of the presence of the larger ribs 24 and 26.

Because modifications may be made to the embodiment illustrated and described without departing from the spirit of the invention, it is not intended that the scope of this invention be limited to that embodiment. Rather, the scope of the invention is to be determined by the following claims and their equivalents.

I claim:

1. A container having a neck defining the container opening and a cap for alternately sealing and venting the container through the opening, said neck and cap each having interrupted threads which mate with one another to permit the cap to be seated on the neck with the interruption of the threads on the cap aligned with the threads on the neck and the interruptions on the neck aligned with the threads on the cap, said threads when mated permitting the cap to be tightened on the neck to seal the container, a stop means on the cap and container limiting the extent to which the cap may enclose the neck with the threads on the cap and neck disengaged to ensure the formation of a vent passage between the cap and neck, and detent means on the cap and container for releasably retaining the cap in the venting position on the neck.

2. A container and cap combination as defined in claim 1 further characterized by, said detent means comprising at least one indexing rib on the container and a detent on the cap, said rib and detent snapping by one another when the cap is rotated from the venting position to the sealed position.

3. A container and cap combination as defined in claim 2 further characterized by, a detent means on the cap and neck releasably retaining the cap on the neck when the cover is in the venting position.

4. A container and cap combination as defined in claim 3 further characterized by, visual means on the container and cap for indicating that the cap is in the venting or sealing position.

5. A container and cap combination as defined in claim 2 further characterized by, said indexing rib being on the container and axially aligned with the interruptions of the threads on the neck, and said detent being on and axially aligned with the threads on the cap and lying beyond the threads and toward the cap opening.

6. A container and cap combination as defined in claim 1 further characterized by, said stop means comprising a thread on the cap and a rib on the neck circumferentially spanning the interruption in the threads on the neck.

7. The vent arrangement of claim 1, further comprising indicator means on the container and closure for visually indicating that the cap is in the sealing or venting position on the container.

8. A container and cap combination as defined in claim 1 further characterized by, a detent means on the cap and neck releasably retaining the cap on the neck when the cap is in the venting position.

* * * * *